United States Patent [19]

Mauk

[11] 4,225,986

[45] Oct. 7, 1980

[54] WATER RELEASE MECHANISM

[76] Inventor: Eugene M. Mauk, 3320 W. Oklahoma, Enid, Okla. 73701

[21] Appl. No.: 51,833

[22] Filed: Jun. 25, 1979

[51] Int. Cl.[2] ..... E03D 1/14; E03D 3/12

[52] U.S. Cl. ..... 4/324; 4/406; 4/367; 4/DIG. 3; 4/305; 4/249

[58] Field of Search ..... 4/406, 249, 367, DIG. 3, 4/305, 324

[56] References Cited

U.S. PATENT DOCUMENTS

| | | | |
|---|---|---|---|
| 407,746 | 7/1889 | Stevens | 4/406 |
| 512,416 | 1/1894 | Voorhees | 4/406 |
| 939,123 | 11/1909 | Christy | 4/406 |
| 1,456,196 | 5/1923 | Staats | 4/406 |
| 2,056,087 | 9/1936 | Andrews | 4/406 |
| 2,626,401 | 1/1953 | Blair | 4/398 |
| 3,090,967 | 5/1963 | Erhardt et al. | 4/406 X |
| 3,108,286 | 10/1963 | Moore | 4/406 X |
| 3,559,217 | 2/1971 | Johnson | 4/406 |
| 4,141,091 | 2/1979 | Pulvari | 4/DIG. 3 |

*Primary Examiner*—Henry K. Artis
*Attorney, Agent, or Firm*—Dunlap, Codding & McCarthy

[57] ABSTRACT

A mechanism for releasing a selected volume of water from a tank has a U-shaped bracket which mounts on the interior of the tank via a bushing which passes through a hole in the wall of the tank. A rod is pivotally supported by the bushing and, in turn, supports a valve which mates with the tank drain when the rod is pivoted to raise a valve support arm to which the valve is attached. A key on a latch arm pivotally mounted on the bracket falls into a notch in the periphery of a latch collar on the rod when the rod is pivoted to raise the valve so that water is drained from the tank so long as the key is engaged by the notch. A float collar journally mounted on the rod is positioned by a float as the water level falls to move an electrical contacting member on the float collar along an arcuate path. Two electrical contacted members on a contactor arm pivotally mounted on the bracket are positioned to be sequentially engaged by the contacting member on the float collar and a battery and switch disposed exteriorly of the tank energize an electromagnet to raise the latch arm when a selected one of the contacted members on the contactor arm is engaged by the contacting member on the float collar.

12 Claims, 5 Drawing Figures

WATER RELEASE MECHANISM

BACKGROUND OF THE INVENTION

1. Field of the Invention

This invention relates generally to improvements in toilet flushing mechanisms and, more particularly, but not by way of limitation, to mechanisms which provide a selection of the volume of water used to flush the toilet.

2. Brief Description of the Prior Art

Devices for flushing toilets have been the subject of numerous patents and a variety of mechanisms having this purpose are to be found in the prior art. Such mechanisms can employ a mechanical linkage as in the flushing device disclosed in U.S. Pat. No. 1,558,342 issued Oct. 20, 1925 to Chittenden and as in the water closet supply cistern disclosed in U.K. Pat. No. 3,641 issued Dec. 17, 1898 to Small. Similarly, it is known to use solenoids to lift a valve for the release of water to the toilet and devices so employing a solenoid are disclosed in U.S. Pat. No. 1,456,196, issued May 22, 1923 to Staats and in U.K. Pat. No. 504,221, issued Apr. 21, 1939 to Palit. Flushing devices are also known wherein an electrically actuated latching mechanism controls the initiation or termination of the flushing of the toilet and such latching mechanisms can, in turn, be controlled by a float which makes or breaks an electrical contact at a selected depth of water in a tank which empties into the toilet. Christy, in U.S. Pat. No. 939,123, issued Nov. 2, 1909, has disclosed a mechanism wherein a catch is released to initiate flushing and Voorhees, in U.S. Pat. No. 512,416, issued Jan. 9, 1894, has disclosed a mechanism wherein an electrically actuated catch is operated via a push-button switch to initiate flushing and operated via a float actuated switch to terminate flushing.

Water conservation can be affected by releasing only a portion of the water stored in a tank for flushing a toilet and a flushing device having this capability has been disclosed by Moore in U.S. Pat. No. 3,108,286, issued Oct. 29, 1963. Similarly, Blair, in U.S. Pat. No. 2,626,401, issued Jan. 27, 1953, has disclosed a device which prevents the initiation of refilling of the tank prior to completion of the flushing operation for water conservation purposes.

SUMMARY OF THE INVENTION

The present invention contemplates a mechanism for flushing a toilet wherein a shaft passing through a hole in the wall of the flush tank can be turned in the usual manner to initiate flushing. A valve is supported off center by the shaft and is lifted from a drain to release water from the tank. A latch is utilized to maintain the shaft in the position wherein the valve is lifted from the tank drain while the selected volume of water is released from the tank. A float is provided to follow the water level in the tank and to close electrical contacts at such time that the selected volume of water has been released. The closure of the contacts energizes an electromagnet to release the latch so that the shaft is free to pivot to permit the valve to drop to and close the drain.

The present invention is provided with a water conservation feature by providing the electrical contacts with three members. One member, which is connected to a power supply, is moved along an arcuate path by the float, and the other members are positioned such that the movement of the member positioned by the float through the complete range of movement thereof will result in sequential engagement by such member with each of the other two members. A switch, located externally of the flush tank connects a selected one of such other two members to the power supply and to the electromagnet which releases the latch. Thus, by positioning the switch to select one or the other of the two members engaged by the member positioned on the float arm, the release of water from the tank can be terminated at either of two levels of water in the tank corresponding to the sequence of positions wherein the member positioned by the float will engage the other two members.

An object of the present invention is to provide a toilet flushing mechanism which releases a selected volume of water to flush the toilet.

Another object of the invention is to provide a toilet flushing mechanism wherein the user of the toilet can select more than one volume of water to be released to flush the toilet.

Other objects and advantages of the invention will be evident from the following detailed description when read in conjunction with the accompanying drawings which illustrate a preferred embodiment of the invention.

DESCRIPTION OF THE PREFERRED EMBODIMENT

Figure 1:
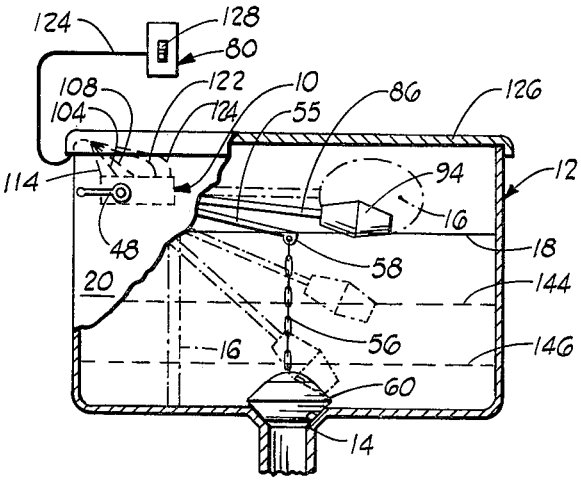
FIG. 1 is a front elevation in partial cutaway of the tank of a toilet incorporating the water release mechanism of the present invention.

Referring now to the drawings in general, and to FIG. 1 in particular, shown therein and designated by the general reference numeral 10 is a water release mechanism constructed in accordance with the present invention. Portions of the water release mechanism 10 are mounted within the tank 12 of a flush toilet, such tank having a drain 14 formed in the bottom thereof. Portions of the water release mechanism 10 are disposed exteriorly of the tank 12 for operation of the water release mechanism 10 by the user of the toilet and for selection of the volume of water to be released to flush the toilet as will be explained below. The tank 12 is provided with a conventional float valve assembly, generally designated 16 in FIG. 1 and shown in phantom lines therein, for refilling the tank 12 to a selected refill level 18 each time the toilet is flushed.

Figure 2:
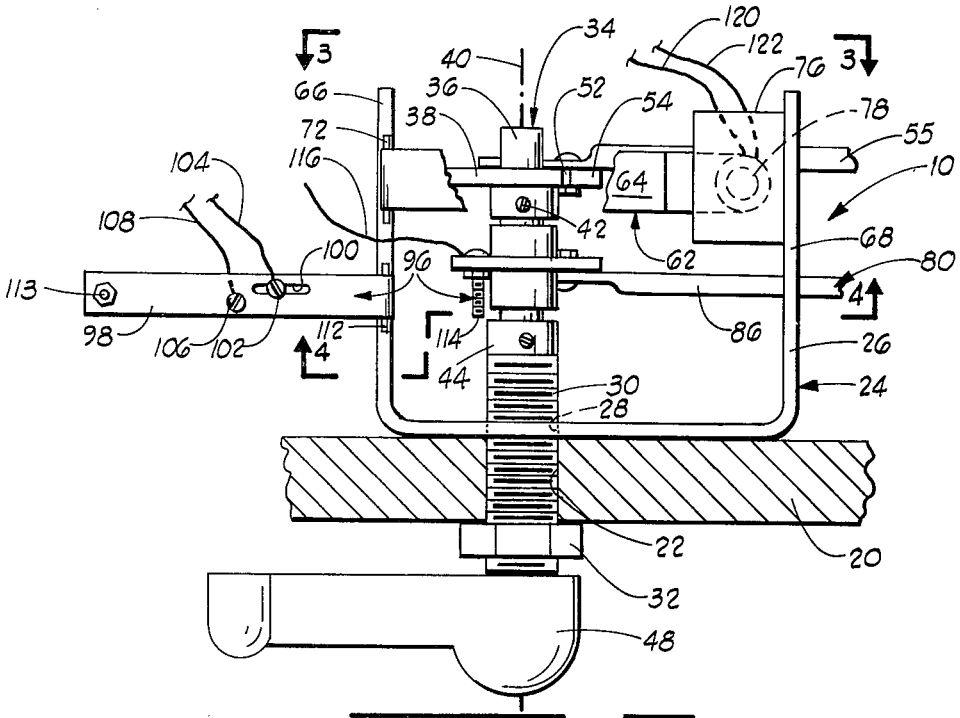
FIG. 2 is a plan view of the water release mechanism.

As shown in FIG. 2, a forward wall 20 of the tank 12 has a hole 22 formed therethrough for mounting the water release mechanism 10 and the positioning of the water release mechanism 10 via the hole 22 has been shown in FIG. 1. Referring specifically to FIG. 2, the water release mechanism 10 includes a shaft assembly 24 comprising a U shaped bracket 26 which is mounted on the interior surface of the forward wall 20 so that the base of the U extends across the hole 22 and the legs of the U extend substantially perpendicularly to the forward wall 20. A hole 28 is formed through the bracket 26 to align with the hole 22 in the forward wall 20 and a bushing 30, passing through the hole 28, is secured to the bracket 26 by any suitable means, for example, by soldering. The bushing 30 passes through the hole 22 in the forward wall 20 of the tank 12 and, in the preferred embodiment, is provided with external threads so that the shaft assembly 24 can be secured to the tank 12 via a nut 32 screwed onto portions of the bushing 30 exterior of the tank 12.

The shaft assembly 24 further comprises a shaft 34 which, in turn, comprises a rod member 36 and a latch collar 38. Portions of the rod member 36 near one end thereof pass through the bushing 30 and are supported thereby for pivotation of the shaft 34 about an axis 40 extending perpendicularly from the forward wall 20. The latch collar 38 is fixed on the rod member 36, near the other end thereof, by any suitable mean as, for example, by set screw 42. The rod member 36 can be axially positioned within the bushing 30 via a collar 44 which is fixed to the rod member 36 to engage the end of the bushing 30 inside the tank 12 and a handle 48 which is fixed on portions of the rod member 36 disposed exteriorly at the tank 12 and which engages the end of the bushing 30 outside the tank 12. The handle 48 also provides a means for pivoting the shaft 34 about the axis 40. The collar 44 utilized to axially position the rod member 36 and engaging the end of the bushing 30 on the interior of the tank 12 is spaced a selected distance from the latch collar 38 for a reason to be discussed below.

The latch collar 38 is generally circular in form and is mounted on the rod member 36 concentrically therewith via a central circular hole 50 (FIG. 3) formed through the latch collar 38. A notch 52 (see also FIG. 3) is formed in the circular outer periphery 54 of the latch collar 38 for a purpose to be discussed below. The shaft 34 can be turned to a water release position wherein the notch 52 is positioned substantially vertically above the rod member 36 as has been indicated in dashed lines in FIG. 3.

Figure 3:
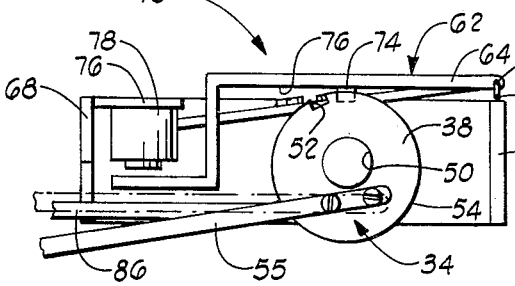
FIG. 3 is an end elevational view of the water release mechanism.

With continuing reference to FIG. 3, the water release mechanism 10 includes a valve support arm 55 which is attached to the latch collar 38 via screws or the like and the valve support arm 55 extends generally laterally from the shaft 34. The valve support arm 55 is normally positioned as has been shown in solid lines in FIG. 3, to underly a portion 68 at the bracket 26 defining one leg of the U to which the bracket 26 conforms, and is raised to the position shown in phantom lines at such time that the shaft 34 is turned to the water release position thereof. (Portions of the portion 68 of bracket 26 can be cut away as indicated in the drawings to provide clearance between the bracket 26 and the valve support arm 55.) As shown in FIG. 1, one end of a chain 56 is attached to the extensive end 58 of the valve support arm 55 and a valve 60 is attached to the other end of the chain 56. The length of the valve support arm 55 and the position of the latch collar 38 on the rod member 36 are selected so that the valve 60 is positioned above the drain 14. The length of the chain 56 is selected so that when the shaft 34 is pivoted to the water release position so as to position the valve support arm 55 as has been shown in phantom lines in FIG. 3, the valve 60 will be lifted from the drain 14 to release water from the tank 12. As will be clear to those skilled in the art, the weight of the valve 60 will tend to pivot the shaft 34 away from the water release position thereof and such tendency can be enhanced by weighting the valve 60 or attaching additional weight to the valve support arm 55.

As is more particularly shown in FIGS. 2 and 3, the water release mechanism 10 includes a latch assembly 62 comprising a generally Z-shaped latch arm 64, constructed of a magnetic material, which is pivotally mounted at one end thereof on a portion 66 of the bracket 26 defining the other leg of the U to which the bracket 26 conforms. The latch arm 64 extends across the bracket 26, substantially to the portion 68 of the bracket 26 and central portions of the latch arm 64 overlay the latch collar 38. A convenient manner of attaching the latch arm 64 to the portion 66 of the bracket 26 has been indicated in FIG. 3. A hole 70 formed through the end of the latch arm 64 which is pivotally connected to the portion 66 of the bracket 26 receives a length of wire 72 having the ends thereof soldered or otherwise secured to the portion 66 of the bracket 26 and extending longitudinally along the portion 66. The latch assembly 62 further comprises a key 74 secured to the underside 76 of the latch arm 64 so as to engage the notch 52 in the latch collar 38 at such times that the shaft 34 is in the water release position thereof. Specifically, when the shaft 34 is turned to the water release position thereof, the notch 52 is brought to a position below the key 74 and the weight of the latch arm 64 pivots the latch arm 64 so that the key 74 drops into the notch 52.

A flange 76 is attached to the top of the portion 68 of the bracket 26 opposite the pivotal connection of the latch arm 64 to the portion 66 of the bracket 26 and supports an electromagnet 78 above the end of the latch arm 64 adjacent the portion 68. The Z shape of the latch arm 64 places such end of the latch arm 64 near the bottom of the bracket 26 so that the electromagnet 78 is disposed within the bracket 26 to simplify the mounting of the electromagnet 78.

Figure 4:
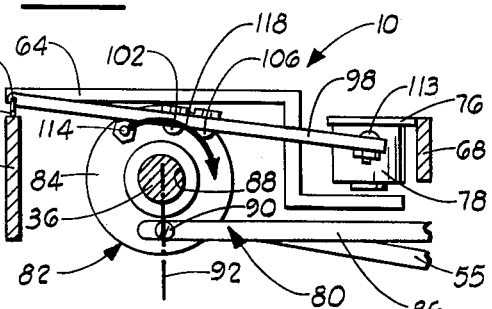
FIG. 4 is a cross-section of the water release mechanism taken along line 4—4 of FIG. 2.

The water release mechanism 10 further comprises a signal generator assembly, generally designated by the numeral 80 in the drawings. The mechanical construction of the signal generator assembly 80 is generally shown in FIGS. 1, 2, and 4 and the circuit diagram therefor has been shown in FIG. 5. Referring first to FIG. 4, the signal generator assembly 80 comprises a float arm 82 which, in turn, comprises a float collar 84 and a float connecting rod 86. The float collar 84 is constructed of an insulating material and has a central circular aperture 88 formed therethrough. The aperture 88 is sized to mate with the rod member 36 of the shaft 34 and the float collar 84 is mounted on the shaft assembly 24 via the mounting of the float collar 84 on the rod member 36 of the shaft 34 between the collar 44 utilized to axially position the shaft 34 in the bushing 30 and the latch collar 38 as has been shown in FIG. 2. The float connecting rod 86 is connected, near one end thereof, to the float collar 84 via a single screw 90, as shown in FIG. 4. The point of connection of the float connecting rod 86 to the float collar 84 defines a reference radius 92 for the float collar 84 and the connection of the float connecting rod 86 to the float collar 84 via a single screw enables the positioning of the float connecting rod 86 on the float collar 84 with reference to the reference radius 92 for a purpose which will be discussed below. As is shown in FIG. 1, a float 94 is connected to the other end of the float connecting rod 86 to follow the level of water in the tank 12. Thus, when the shaft 34 is turned to lift the valve 60 from the drain 14 so that water is released from the tank 12, the float arm 82 will pivot about the rod member 36 of the shaft 34 such that the float collar 84 rotates on the rod member 36.

The signal generator assembly 80 further comprises a contactor assembly 96 as shown in FIG. 2. The contactor assembly 96 includes a contactor support arm 98 constructed of an electrically insulating material and pivotally attached at one end thereof to the portion 66 of the bracket 26 defining one leg of the U shape to which the bracket 26 conforms. An elongated slot 100 is formed through a medial portion of the contactor support arm 98 and extends longitudinally of the contactor support arm 98. The contactor assembly 96 includes a first contacted member 102 which is preferably a screw which passes through the slot 100 and is secured to the contactor support arm via a nut in the usual fashion. An electrical conductor 104 is connected to the contactor support arm 98 via the first contacted member 102 so that the conductor 104 is in electrical contact with the first contacted member 102. A hole (not shown) is formed through the contactor support arm 98 and a second contacted member 106 and conductor 108 are mounted on the contactor support arm 98 via such hole (not shown) in the same manner that the first contacted member 102 and the conductor 104 are mounted on the contactor support arm 98. The hole (not shown) for mounting the second contacted member 106 is positioned in the contactor support arm 98 such that the slot 100 is disposed between the hole (not shown) for the second contacted member 106 and the pivotal connection of the contactor support arm 98 to the portion 66 of the bracket 26.

The contactor support arm 98 is connected to the bracket 26 in the same manner that the latch arm 64 is connected thereto. That is, a hole 110 (FIG. 4) is formed through the contactor support arm 98 near the end thereof connected to the bracket 26 and a piece of wire 112 extends through the hole 110 and is soldered or otherwise secured to the bracket 26 to effect the pivotal connection of the contactor support arm 98 to the bracket 26. Another hole (not shown) is formed through the contactor support arm 98, near the other end thereof, and a screw 113 is mounted in the hole near such other end of the contactor support arm 98 for a purpose to be discussed below.

For clarity of illustration, the contactor support arm 98 has been shown in FIG. 2 as extending away from the portion 68 of the bracket 26 opposite the portion 66 thereof whereon the contactor support arm 98 is mounted. When the water release mechanism 10 is mounted on the tank 12 for use, the contactor support arm 98 is pivoted to the position thereof shown in FIG. 4 wherein the contactor support arm 98 extends across the bracket 26 so that portions of the contactor support arm 98 whereon are mounted the first and second contacted members 102 and 106 respectively are disposed alongside the float collar 84. The contactor assembly 96 further comprises a contacting member 114 which is mounted on the float collar 84 and extends to the side thereof to underlay the contactor support arm 98. As is shown in FIG. 2, it is convenient for the contacting member 114 to be a nut and screw connected to the float collar 84 via a hole (not shown) passing therethrough. As in the case of the contacted members 102 and 106, the contacting member 114 secures a conductor 116 to the float collar 84 and the contacting member 114 is in electrical contact with the conductor 116. As will be clear to those skilled in the art, the mounting of the contacting member 114 on the float collar 84 causes the contacting member to be moved along an arcuate path as the float collar 84 is pivoted on the rod member 36 of the shaft 34 by a drop in the water level in the tank 12. Such path has been indicated in FIG. 4 and is designated 118 therein.

The conductors 104, 108 and 116 are bundled together with conductors 120 and 122 (FIG. 2) which are connected to the electromagnet 78 to form a cable 124 which is brought out of the tank 12, as shown in FIG. 1, between the upper lip of the tank 12 and a lid 126 therefor. The cable 124 connects to a source of electrical power outside the tank 12 and to a double-pole double-throw switch 128, which, together with the conductors 104, 108, 116, 120 and 122 and the contactor assembly 96, forms a switch assembly for the water release mechanism 10 which will now be described with reference to FIG. 5.

Figure 5:
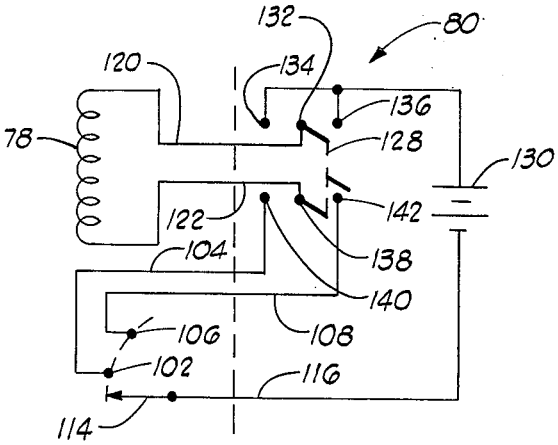
FIG. 5 is a schematic diagram of the electrical circuit of the water release mechanism.

The source of electrical power for the switch assembly can conveniently be a battery 130 as has been schematically indicated in FIG. 5. For reasons that will be clear to those skilled in the art, it is preferable that the water release mechanism 10 operate from a low voltage source and such source can be a battery or can be a transformer energized by electric power supplied a public utility. The applicant has found that the power requirements for the water release mechanism 10 are sufficiently low that many months of operation of the water release mechanism 10 can be obtained without replacing the battery 130 so that the use of a battery rather than electrical power supplied by public utility at a significantly higher voltage than is required to operate the water release mechanism 10 provides the water release mechanism 10 with a significant safety factor.

As shown in FIG. 5, the conductor 116 connected to the contacting member 114 is also connected to one terminal of the battery 130. The switch 128 has a first common terminal 132, to which the conductor 120 is connected, and the switch 128 can be thrown in either of two directions to electrically connect the first common terminal 132 to either of two fixed terminals 134, 136 which are both connected to the other terminal of the battery 130. The switch 128 has a second common terminal 138, connected to the conductor 122, and the switch 128 can be thrown in one direction to connect the second common terminal 138 to a terminal 140 to which the conductor 104, leading to the first contacted member 102, is connected. Similarly, the switch 128 can be thrown in an opposite direction to connect the common terminal 138 to a terminal 142 of the switch 128 to which the conductor 108, leading to the second contacted member 106, is connected. Thus, as shown in FIG. 5, the switch 128 can be thrown in one direction so that a circuit is completed between the battery 130 and the electromagnet 78 at such time that the contacting member 134 engages the first contacted member 102 and the switch 128 can be thrown in the opposite direction so that an electrical circuit is completed between the battery 130 and the electromagnet 78 at such time that the contacting member 114 engages the second contacted member 106.

As will be clear from the discussion of the water release mechanism 10 to follow, the switch 128 permits the user of a toilet whereon the water release mechanism 10 is mounted to select one of two volumes of water to be released to flush the toilet. Such volumes have been indicated in FIG. 1 via dashed lines 144 and 146, which indicate the level of water in the tank 12 for each of the two selections, at such time that flushing of the tank has been completed but before the float valve assembly 16 has caused the tank 12 to be refilled. The above described construction of the water release mechanism 10 permits the water level 144 and 146 to be preset in the following manner. As has been discussed above, portions of the water release mechanism 10 mounted on the tank 12 are mounted thereon via the nut 32 on the bushing 30. With such portions of the water release mechanism 10 so mounted, the water level 146 can be preset by positioning the float connecting rod 86 with reference to the reference radius 92 (FIG. 4) such that the float 94 will position the contacting member 114 on the arcuate path 118 to contact the second contacted member 106 when the water level in the tank is the water level 146. The water level 144 is then preset by positioning the first contacted member 102 in the slot 100 so that the float 94 will position the contacting member 114 so as to engage the first contacted member 102 when the water level in the tank 12 is the water level 144.

OPERATION OF THE PREFERRED EMBODIMENT

The double-pole, double-throw throw switch 128 can be conveniently mounted, for example on a wall, in the immediate vicinity of the tank 12. At such time that a toilet equipped with the water release mechanism 10 is to be flushed, the user thereof initially selects the volume of water to be released for such purpose via the switch 128. For example, should it be desired to release water to the level 144, the user of the toilet positions the switch 128 such that the common terminal 132 thereof is electrically connected to the fixed terminal 134 while the other common terminal 138 is electrically connected to the fixed terminal 140. The handle 48 is then turned to pivot the shaft 34 to the water release position wherein the notch 52 in the latch collar 38 underlies the key 74 on the latch arm 64 (FIG. 3). Accordingly, the latch arm 64 will pivot about the end thereof mounted on the portion 66 of the bracket 26 such that the key 74 enters the notch 52 to fix the latch collar 38 in position. The pivotation of the latch collar 38 lifts the valve support arm 55 to the position shown in phantom lines in FIG. 3 and such lifting of the valve support arm 55 raises the valve 60 from the drain 14 to initiate the release of water from the tank 12.

The release of water from the tank 12 results in a lowering of the water level therein and the float 94 follows the water level in the tank 12 to rotate the float collar 84 so as to move the contacting member 114 along the arcuate path 118 shown in FIG. 4. As the contacting member 114 moves along the arcuate path 118, the contacting member 114 will engage the contactor support arm 98 and the weight of the screw 113 at the free end of the contactor support arm 98 presses the contactor support arm 98 firmly against the contacting member 114. When the float 94 reaches the upper of the two positions thereof shown in phantom lines in FIG. 1, the contacting member 114 will be brought into contact with the first contacted member 102. Referring to FIG. 5, the contact between the contacting member 114 and the first contacted member 102 completes a circuit between the battery 130 and the electromagnet 78 via the conductors 104, 116, 120 and 122 and via the electrical contact between terminals 132 and 134 and terminals 138 and 40 of the switch 128. Accordingly, when the water level in the tank 12 reaches the water level 144, the electromagnet 78 is energized to lift the free end of the latch arm 64 and, accordingly, to lift the key 74 from the notch 52 in the latch collar 38. The removal of the key 74 from the notch 52 frees the shaft 34 for pivotation away from the water release position thereof so that the valve 60 is freed to fall to the drain 14 and terminate the release of water from the tank. The float valve assembly 16 then refills the tank 12 to the fill level 18.

Should it be desired to release water to the level 146, the switch 128 is positioned so that the common terminals 132 and 138 thereof engage the fixed terminals 136 and 142 respectively thereof. Flushing of the tank is then initiated as before so that the shaft 34 is fixed in position by the latch assembly 62 while water is released from the tank to lower the water level therein. The contacting member 114 moves along the arcuate path 118 and successively engages the first contacting member 102 and the second contacting member 106. When the float 94 reaches the lower of the two positions the rest shown in FIG. 1, so that the contacting member 114 engages the second contacted member 106, an electrical circuit between the battery 130 and the electromagnet 78 is completed via the conductors 108, 116, 120 and 122 and via the contact between terminals 132 and 136 and terminals 138 and 142 to energize the electromagnet 78 as above. Accordingly, the electromagnet 78 lifts the latch arm 64 to remove the key 74 from the notch 52 so that the valve 60 is again dropped to close the drain 14. The float valve assembly 16 then refills the tank 12 to the fill level 18 as before.

It is clear that the present invention is well adapted to carry out the objects and obtain the ends of the advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the appended claims.

What is claimed is:

1. A mechanism for releasing a selected volume of water from a tank, comprising:

a shaft assembly secured to the wall of the tank, comprising:

a bracket inside the tank;

a bushing connected to the bracket and extending through a hole in the wall of the tank; and a shaft extending through the bushing and supported thereby for positioning of the shaft in a preselected water release position and for pivotation of the shaft from the water release position;

a valve support arm fixed on the support arm and extending laterally therefrom, wherein a drain for the tank is formed below extensive portions of the valve support arm;

a valve suspended from the valve support arm over the drain in the water release position of the shaft, whereby the weight of the valve urges the shaft to pivot away from the water release position so as to lower the valve to a position wherein the valve closes the drain;

latch means, engagable with the shaft in the water release position of the shaft, for holding the shaft in the water release position in an engaged condition of the latch means with the shaft and for freeing the shaft for pivotation from the water release position in a disengaged condition of the latch means with the shaft;

latch release means for placing the latch means in the disengaged condition thereof with the shaft in response to an electrical signal;

signal generator means responsive to the depth of water in the tank for providing the electrical signal to the latch release means at a preselected water depth; and means for introducing water into the tank at such times that the depth of water therein is less than a preselected depth.

2. The apparatus of claim 1 wherein the signal generator means comprises:

a float arm pivotally mounted at one end thereof on the shaft assembly;

a float mounted on the extensive end of the float arm for pivoting the float arm in relation to the water level in the tank; and switch means for transmitting the electrical signal to the latch release means at a preselected position of the float arm.

3. The apparatus of claim 2 wherein the switch means comprises:

a contactor assembly, comprising:

a contacting member mounted on the float arm for movement along an arcuate path as the float arm pivots; and a contacted member mounted on the shaft assembly so as to be engaged by the contacting member at a preselected position of the contacting member on said arcuate path; and power supply means connecting the contactor assembly to the latch release means for transmitting the electrical signal to the latch release means at such times that the contacting member engages the contacted member.

4. The apparatus of claim 3 wherein the float arm comprises:

a float collar journaled on a shaft assembly; and a float connecting rod connected at one end thereof to the float collar and connected at the other end thereof to the float;

wherein the float connecting rod is connected to the float collar so as to be positionable thereon with respect to a reference radius extending from the journal axis of the float collar; and wherein the contacting member is mounted on the float collar.

5. The apparatus of claim 4 wherein the float collar has a bore formed therethrough coaxially with the journal axis thereof and wherein said bore slidably receives a portion of the shaft so as to journal the float arm on the shaft.

6. The apparatus of claim 1, 2, 3, 4 or 5 wherein the shaft comprises:

a circular rod member mounted in the bushing; and a circular latch collar coaxially mounted on the rod member and having a notch formed in the circular periphery thereof, said notch being disposed above the rod member in the water release position of the shaft;

wherein the latch means comprises:

a latch arm pivotally supported at one end thereof on the bracket and portions of the latch arm overlaying the latch collar; and a key, shaped to mate with the notch in the latch collar, mounted on the underside of the latch arm to engage the notch in the latch collar in the water release position of the shaft, whereby the weight of the latch arm urges the key into the notch at such times that the shaft is pivoted to the water release position thereof; and wherein the latch release means is an electromagnet positioned above the other end of the latch arm.

7. The apparatus of claim 6 wherein the contactor assembly further comprises a contactor support arm pivotally mounted at one end thereof on the bracket; wherein portions of the contactor support arm overlay the contacting member of the contactor assembly; and wherein the contacted member is mounted on the contactor support arm.

8. The apparatus of claim 2 wherein the switch means comprises:

a contactor assembly, comprising:

a contacting member mounted on the float arm for movement along an arcuate path as the float arm pivots;

a first contacted member mounted on the shaft assembly so as to be engaged by the contacting member at a preselected position of the contacting member on said arcuate path; and a second contacted member mounted on the shaft assembly so as to be engaged by the contacting member at another preselected position of the contacting member on said arcuate path; and power supply means, connecting the contactor assembly to the latch release means, for transmitting the electrical signal to the latch release means at such times that the contacting member engages a selected one of the contacted members, wherein the power supply means is characterized as comprising means, disposed exteriorly of the tank, for selecting said selected one of the contacted members.

9. The apparatus of claim 8 wherein the contactor assembly further comprises a contactor support arm pivotally mounted at one end thereof on the bracket; wherein portions of the contactor support arm overlay the contacting member of the contactor assembly; and wherein the contacted members are mounted on the contactor support arm.

10. The apparatus of claim 9 wherein one of the contacted members is fixedly mounted on the contactor support arm; wherein the other of the contacted members is positionable on the contactor support arm; wherein the float arm comprises:

a float collar journaled on the shaft assembly; and a float connecting rod connected at one end thereof to the float collar and connected at the other end thereof to the float; and wherein the float connecting rod is connected to the float collar so as to be positionable thereon with respect to a reference radius extending from the journal axis of the float collar; and wherein the contacting member is mounted on the float collar.

11. The apparatus of claim 10 wherein the float collar has a bore formed therethrough coaxially with the journal axis thereof and wherein said bore slidably receives a portion of the shaft so as to journal the float arm on the shaft.

12. The apparatus of claim 8, 9, 10 or 11 wherein the shaft comprises:

a circular rod member mounted in the bushing; and a circular latch collar coaxially mounted on the rod member and having a notch formed in the circular periphery thereof, said notch being disposed above the rod member in the water release position of the shaft;

wherein the latch means comprises:

a latch arm pivotally supported at one end thereof on the bracket and portions of the latch arm overlaying the latch arm; and a key, shaped to mate with the notch in the latch collar, mounted on the underside of the latch arm to engage the notch in the latch collar in the water release position of the shaft, whereby the weight of the latch arm urges the key into the notch at such times that the shaft is pivoted to the water release position thereof; and wherein the latch release means is an electromagnet positioned above the other end of the latch arm.

* * * * *